US005156493A

United States Patent [19]

Johnson

[11] Patent Number: 5,156,493

[45] Date of Patent: Oct. 20, 1992

[54] DOCK KIT

[76] Inventor: Richard D. Johnson, 19400 Orwell Ave., Marine-On-St. Croix, Minn. 55047

[21] Appl. No.: 653,681

[22] Filed: Feb. 11, 1991

[51] Int. Cl.[5] ..... E02B 3/20

[52] U.S. Cl. ..... 405/221; 403/385; 403/391; 405/218

[58] Field of Search ..... 405/218, 221, 220; 403/234, 235, 236, 391, 385; 108/106, 107; 52/126.5, 299; 211/176, 177, 178, 182, 187, 191; 248/243

[56] References Cited

U.S. PATENT DOCUMENTS

| | | | |
|---|---|---|---|
| 1,851,973 | 4/1932 | Brandt | 403/391 X |
| 2,057,329 | 10/1936 | Duff | 403/385 |
| 2,152,891 | 4/1939 | Kohnke | 403/385 |
| 3,345,825 | 10/1967 | Parker | 405/218 |
| 3,421,327 | 1/1969 | Donaldson | 405/220 |
| 3,614,871 | 10/1971 | Nordell | 405/221 |
| 3,861,816 | 1/1975 | Zaidan | 403/391 X |
| 3,953,980 | 4/1976 | Bennett . | |
| 4,037,420 | 7/1977 | Wicks | 405/218 |
| 4,074,537 | 2/1978 | Gronlie | 405/218 |
| 4,087,977 | 5/1978 | Kuhlman | 405/218 |
| 4,260,293 | 4/1981 | Peterson | 405/221 X |

FOREIGN PATENT DOCUMENTS

| | | | |
|---|---|---|---|
| 2258549 | 8/1975 | France | 403/234 |
| 765360 | 1/1957 | United Kingdom | 403/235 |

*Primary Examiner*—Dennis L. Taylor
*Attorney, Agent, or Firm*—Jacobson and Johnson

[57] ABSTRACT

A dock kit to permit an owner to assemble or disassemble a dock comprising a dock post bracket for laterally inserting a dock post therein, a reversible cross-latch member for locking a dock post in the dock-post bracket with the reversible cross-latch member operable for engaging a dock-abutment bracket to support an adjacent dock section when the cross-latch member is located in one direction in the dock-post bracket and when reversed is usable as an end support for the dock-post bracket. The brackets provide both corner reinforcement for a dock-deck section as well as permitting a single dock post to support corners of adjacent dock-deck sections. A split foot pad permits adjustment of the depth the dock post extends into the soil. A hanger bracket permits one to support the corner of an adjacent dock-deck section without using an extra dock post.

11 Claims, 5 Drawing Sheets

DOCK KIT

FIELD OF THE INVENTION

This invention relates generally to docks, and more specifically, to dock kits that reinforce dock corners yet allow a person to assemble and dissemble a dock quickly.

BACKGROUND OF THE INVENTION

One of the difficulties in building a dock is having the special dock bracket hardware to support adjacent dock-deck sections. In colder climates a dock owner usually installs the dock every spring and takes it out in the fall. To simplify assembly and disassembly of a dock, its supporting hardware must allow easy disassembly yet provide rigid corner support to the dock-deck sections so that the dock can withstand the weather forces acting on it as well as support substantial loads.

The present invention provides a dock kit which a dock owner can use to securely support single or multiple dock-deck sections proximate to one another yet permits easy disassembly so that an owner can take apart the dock for storage. In addition, the dock kit provides corner reinforcement for the dock-deck sections to provide a stable dock.

DESCRIPTION OF THE PRIOR ART

Nordell U.S. Pat. No. 3,614,871 shows a dock bracket including connecting elements which have arcuate recesses for positioning around a dock post with a bolt for sandwiching the elements around a dock post.

Bennett U.S. Pat. No. 3,953,980 shows a collar-like dock-post bracket with the dock post inserted through the collar and a bolt holding it in place Wicks U.S. Pat. No. 4,037,420 shows a dock-post bracket with a similar circular opening for insertion of a bolt through the collar to lock a dock-post bracket in position.

Gronlie U.S. Pat. No. 4,074,537 shows a dock-post bracket with sleeves for the dock post and a cross-brace at right angles to one another which permits the bracket to engage a dock post and support a dock-deck.

Kuhlman U.S. Pat. No. 4,087,977 shows a dock-post bracket and a dock post with pins that can support a sleeve.

SUMMARY OF THE INVENTION

Briefly, the present invention comprises a dock kit including a dock-post bracket, a dock-abutment bracket, a cross-latch member, a hanger, and a two-piece foot pad. A dock owner can use the dock kit components separately or with other components to permit him or her to construct corner supports for dock-deck sections. The owner can use a cross-latch member to link the dock-abutment bracket and the dock-post bracket so that a single dock post can support adjacent corners of two dock-deck sections. The cross-latch member can be removed from the dock-post bracket so the dock post and foot pad can be laterally discharged from side of the dock to permit easy removal of the dock-deck sections when the dock posts and foot pads are embedded in lake bottom. The hanger bracket hooks over a stringer of an adjacent dock-deck section to permit the owner or user to support the corner of a dock-deck section without using a dock post. The two-piece foot pad allows the owner to extend the dock post beyond the foot pad so that the dock post stabilizes the dock. The cross-latch member is asymmetrical to allow the owner to reverse the orientation so it can function as an end member of a support for a dock-abutment bracket.

DESCRIPTION OF THE PREFERRED EMBODIMENT

Figure 1:
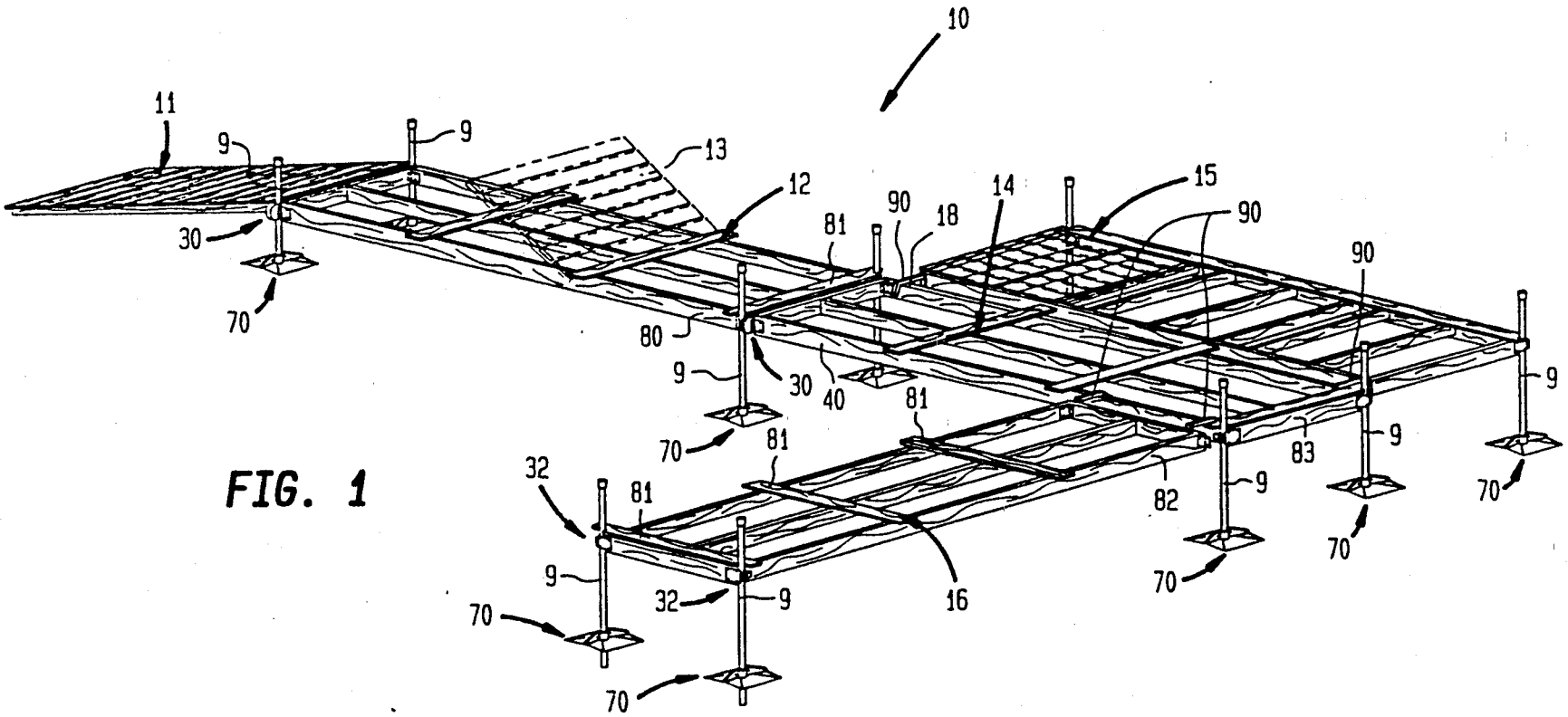
FIG. 1 shows a perspective view of a dock built with the dock kit of the present invention.

Referring to FIG. 1 reference numeral 10 generally identifies a dock made of a number of dock-deck sections 11, 12, 14, 15, and 16 each having corner reinforcements. Either a dock post or a hanger bracket connected to an adjacent dock section supports each of the corners of the dock-deck sections located over the water. For clarity, FIG. 1 does not show the top deck boards of some of the dock-deck sections.

The dock 10 includes a ramp dock section 11 having one end which extends onto shore and the other end which extends over water. Dock posts 9 support one end of the ramp dock-deck section 11.

Two dock posts 9 support one end of a second dock-deck section 12 that also support dock-deck section 11; two additional dock posts 9 support the other end of dock-deck section 12. Connected to dock-deck section 12 in an end-to-end relationship is a third dock-deck section 14 supported on one end by the two dock posts 9 which also support dock-deck section 12 and on the opposite end by two further dock posts 9.

Extending parallel to one side of dock section-deck 14 is another dock-deck section 15. Dock-deck section 15 includes a hanger bracket 90 for engaging dock-section stringer 18 to support one corner of dock-deck section 15 and additional dock posts 9 for supporting the other corners of dock-deck section 15. Similarly, dock-deck section 16 include hangers brackets 90 which engage dock-deck stringer 40 to support one end of dock-deck section 16 and additional dock posts 9 for supporting the opposite end of dock-deck section 16.

Each of the dock posts is identical and includes two-piece adjustable foot pads 70 which an owner can clamp to dock post 9 anywhere along cylindrical dock post 9. Typically, dock posts 9 are sections of galvanized pipe which an owner has cut to the proper length. A feature of the dock kit of the present invention is that it includes components which allow adjacent dock-deck sections to share the same dock post or to use the stringer of an adjacent dock-deck section for a corner support.

The split foot pads 70 permit the owner to anchor the dock posts in the lake bottom; that is, if the owner wants to ensure that the dock foot pads do not move or shift along the bottom of the lake as a result of wind or wave action, he or she extends the dock posts through the foot pads 70 until the dock posts project beyond the foot pads into the soil beneath the foot pads.

FIG. 1 illustrates this feature showing dock posts 9 on dock-deck section 16 extending beyond foot pads 70. The small cross-sectional surfaces of dock post 9 readily sink into the soft lake bottom and provide lateral stability while the large size of the foot pads (about one square foot) prevents them from sinking into the lake bottom. Consequently, the dock post and foot pad stabilize the dock post and prevent it from shifting. The dock post and foot pad also vertically support and hold the dock-deck sections at the proper height.

Figure 2:
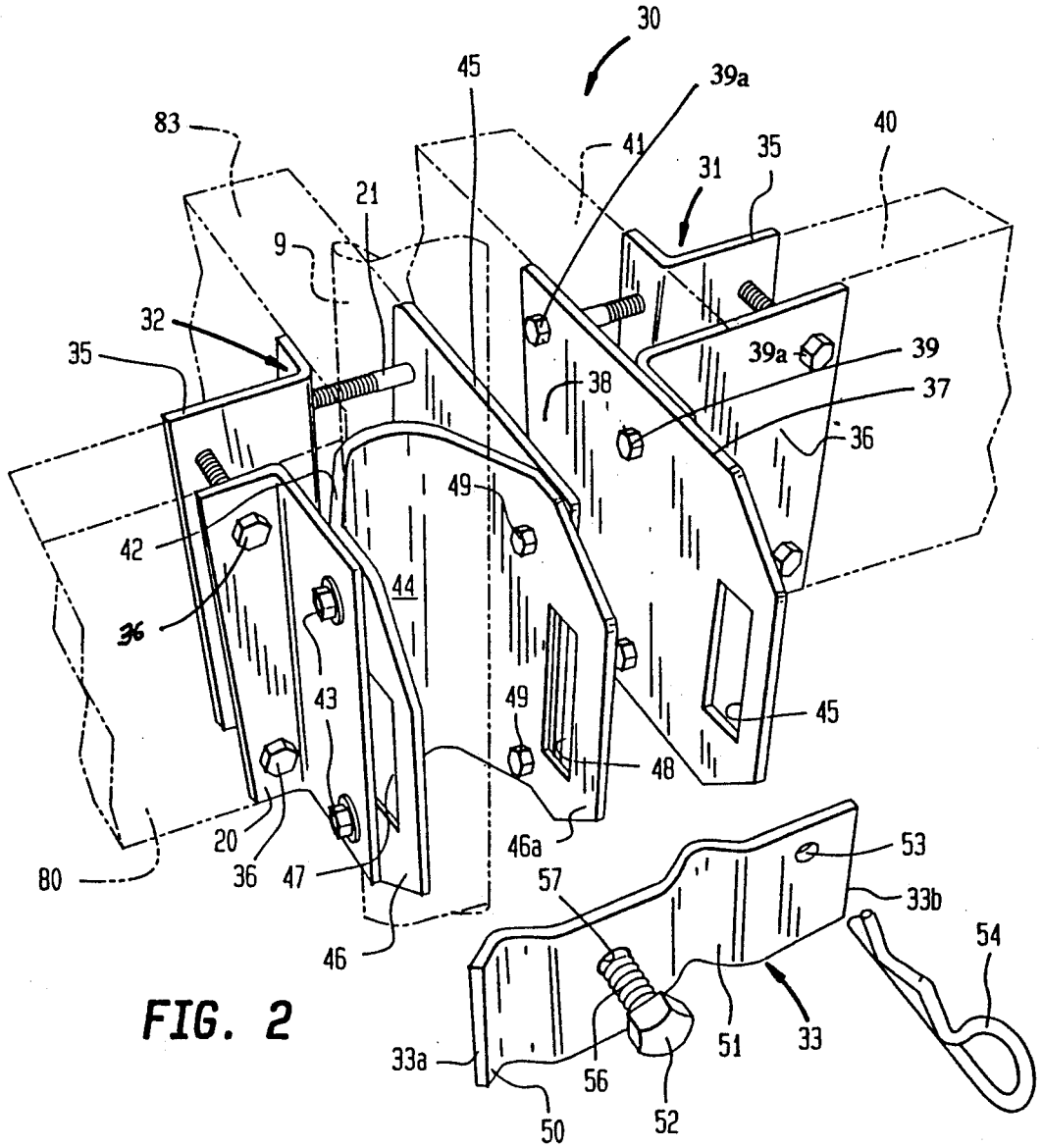
FIG. 2 shows an exploded view of the dock kit containing a dock-post bracket, a dock-abutment bracket and a cross-latch member for engaging a dock post, the dock-post bracket and the abutment bracket.
Figure 5:
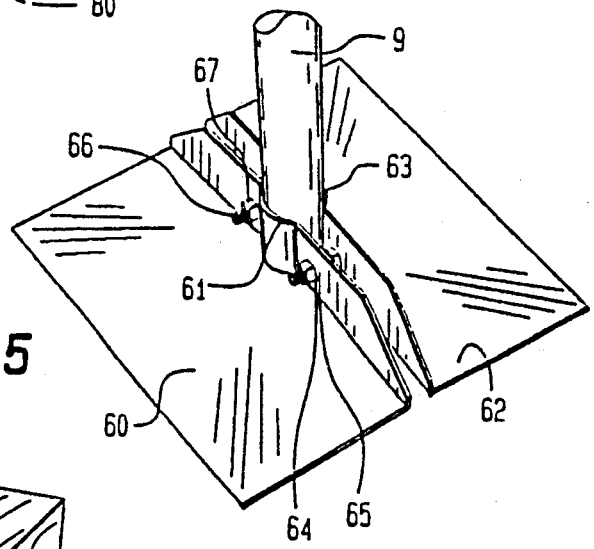
FIG. 5 shows a two-part foot attached to the dock post.
Figure 6:
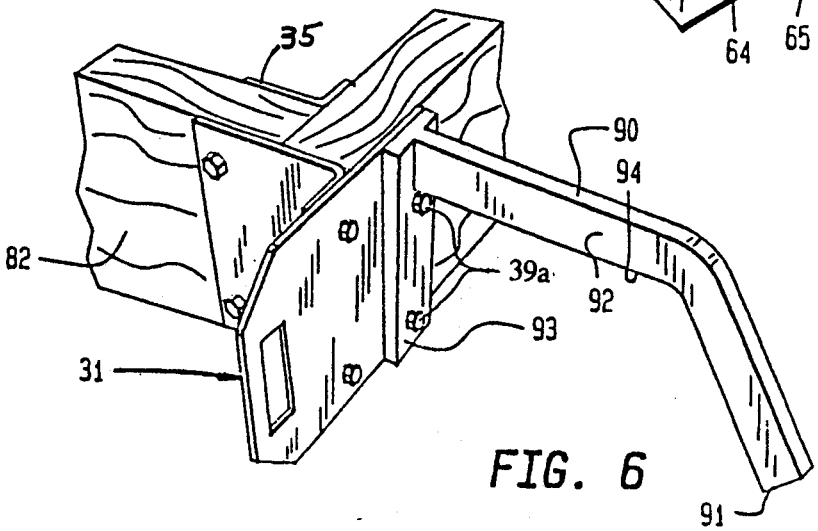
FIG. 6 shows a side hanger bracket for attaching a dock section to an adjacent dock without the use of a dock post for support.

FIG. 2 shows the multiple-purpose dock kit 30 for use in supporting and reinforcing corners of single dock-deck sections or corners of adjacent dock-deck sections on a single dock post. FIG. 5 shows the dock kit two-piece foot pad and FIG. 6 shows the dock kit hanger bracket.

The dock kit 30, which reinforces and supports corners of adjacent dock-deck sections, includes a dock-post bracket 32, a dock-abutment bracket 31, and a cross-latch member 33. The owner can use these brackets together or individually. To support and reinforce only one corner of a dock-deck, the owner need only use dock-post bracket 32 and cross-latch member 33. To support one corner of a dock-deck section and the corner of an adjacent dock-deck section with a single dock post, the owner connects dock-post bracket 32 and dock-abutment bracket 31 to each other with cross-latch member 33. Extending cross-latch member 33 into engagement with both dock-post bracket 32 and dock-abutment bracket 31 allows a dock owner to tie the two brackets together so he or she needs only one dock post to support the corners of two adjacent dock-deck sections.

Dock-post bracket 32 comprises a first L-shaped flange 35 and a second L-shaped flange 20 which are identical. A flat plate 45 extends outward from one side of dock-post bracket 32 to engage a U-shaped dock-post engaging member 42 having a first ear 46 with a rectangular opening 47 and a second ear **46*a* with a rectangular opening 48. Openings 47 and 48 are in substantial alignment with one another so that an owner can insert cross-latch member 33 therein. Bolts 36 tightly sandwich flanges 35 and 20 around dock-deck stringer 80 and bolts 21 tightly sandwich flange 35 and plate 45 around cross member 83 to provide a rigid right angle corner connection to both the stringer and the cross member of a dock-deck section. Bolts 49 hold one side of a U-shaped member 42 to plate 45 and bolts 43 hold the other side of U-shaped member 42 to flange 20 to provide an integral dock-post bracket 32 having a U shaped back portion 44** for laterally receiving a cylindrical dock post.

Dock-post abutment bracket 31 comprises a first L-shaped flange 35 and a second L-shaped flange 36. A flat plate 38 extends outward from one side of cross member 41. Plate 38 has a first ear with a rectangular opening 45. Opening 45 is in substantial alignment with openings 47 and 48 so that an owner can insert a cross-latch member 33 therein. Bolts **39*a* tightly sandwich flanges 35 and 36 around dock deck stringer 40 and bolts 39*a* tightly sandwich flange 35 and plate 38 around cross member 41** to provide a rigid rectangular corner connection to both the stringer and the cross member of a dock-deck section.

It should be noted that both dock-post bracket 32 and dock post-abutment bracket 31 provide corner reinforcement by sandwiching both the stringer and the cross member of the dock-deck section together. Thus my brackets provide inside and outside corner reinforcement for a dock-deck section as well as permits adjacent dock-deck section to be supported by a single post.

The width of the U-shaped back portion 44 of U-shaped member 42 is slightly larger than the outside diameter of dock post 9 (shown in phantom) so that a dock owner can laterally insert a dock post 9 into the U-shaped region formed by back portion 44. The spacing of openings 47 and 48 is sufficiently forward to allow insertion of cross-latch member 33 through openings 47 and 48 which forms a loose-fitting enclosure around dock post 9.

Cross-latch member 33 comprises a generally rectangular piece of metal having a first ear stop 50 for engaging ear 46 and a second ear stop 51 for engaging ear **46*a*. Between ear stops 50 and 51 is a threaded opening 57 for receiving a stud bolt 52 having threads 56 for engaging threaded opening 57. Threads 56 can either be placed in cross-latch member 33 or can be formed by welding a nut with the proper size thread directly to the back side of cross-latch member 33. End 33*a* includes first ear stop 50 proximate to the end of the cross-latch member while end 33*b* includes an extension proximate to second ear stop 51. End 33*b* extends outward to form supporting and locking engagement with the ear of dock-abutment bracket 31**.

To lockingly engage dock-post bracket 32 around a dock post, the dock owner inserts end **33*b* of cross-latch member 33 having an opening 53 through opening 48 and then longitudinally slides cross-latch member 33 through opening 48 until end 33*a* of cross-latch member 33 clears ear 46. The dock owner then inserts end 33*a* of cross-latch member 33 into opening 47 and axially slides the cross-latch member 33 until ear stop 50 is proximate to ear 46 and ear stop 51 is proximate to ear 46*a*. The owner then tightens stud bolt 52 until its threaded end engages and bites into the outside of cylindrical post 9. The coaction of stud bolt 52, cross-latch member 33 and U-shaped member form a frictional engagement with post 9 to securely hold dock-post bracket on dock post 9**.

In the preferred embodiment in FIG. 2 the cross members 41 and 83 extend the full length into the brackets with the stringers 40 and 80 abutting against them.

Figure 3:
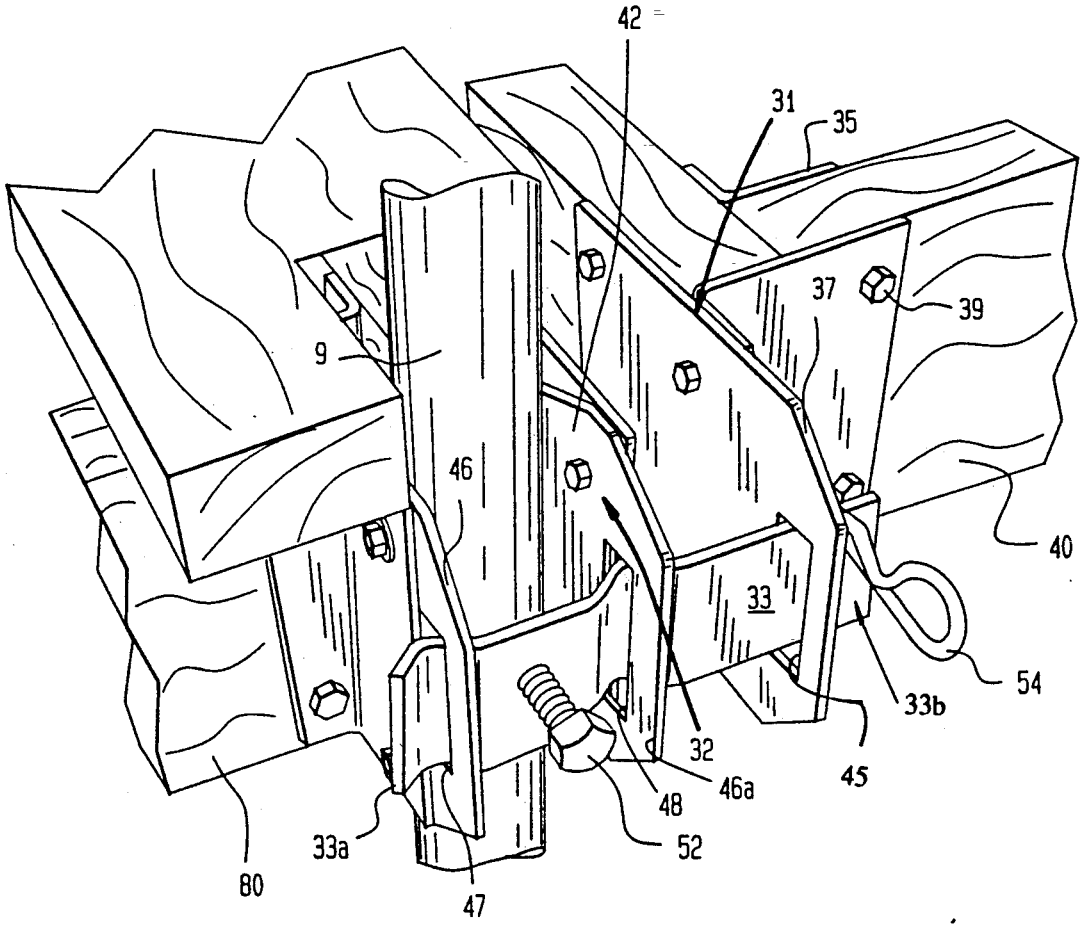
FIG. 3 shows an assembled view of the dock kit shown in FIG. 2.

FIG. 3 illustrates cross-latch member 33 tying together dock-post bracket 32 and dock-abutment bracket 31 which permits a single dock post to support reinforced corners of adjacent dock-deck sections. Cross-latch member 33 mounts in openings 47 and 48 so that tightening stud bolt 52 produces a frictional lock between dock post 9 and dock-post bracket 32; that is, the combination of the U-shaped member 42 in dock-post bracket 32 and cross-latch member 33 with stud bolt coact 52 coact to permit the owner to tighten the stud bolt and thus securely fasten dock-post bracket 32 to dock post 9. To support the corner of an adjacent dock-deck section with the same dock post, the owner inserts the extension end **33*b* in the cross-latch member 33 into rectangular opening 45 in dock-abutment bracket 31. Once inserted, the owner extends a cotter key 54** through opening 53 in cross-latch member 33 to lock dock-abutment bracket 31 together with its dock-deck section proximate to dock-post bracket 32. This arrangement is particularly advantageous since it requires only one dock post 9 to support the ends of two dock-deck sections. In addition, assembly is simple since all the owner has to do is place the opening in dock-abutment bracket 31 on cross-latch member 33 and insert cotter pin 54 into opening 53 to lock the two sections together.

Notice that dock-abutment bracket 31 is similar to dock-post bracket 32. Bolts 39*a* tightly sandwich plate 37 to cross member 41, and bolts 39*a* tightly sandwiches flanges 35 and 36 to stringer 40 to provide a rigid corner support for dock-deck sections that includes flanges with right angle metal supports on both the inside and outside corner of a dock-deck section.

If a dock owner wants to disassemble the dock, he or she simply removes cotter pin 54 to free dock-abutment bracket 31 from cross-latch member 33. Next, he or she loosens stud bolt 52 allowing the dock-deck section to slide down into the water. Generally made of wood, dock-deck sections float; or an owner can place flotation devices under the dock-deck section to keep them above the water.

After loosening stud bolt 52, the owner can slide cross-latch member 33 to the right until end 33*a* is free of opening 47. The owner then pulls end 33*a* outward until it clears ear 46. Once end 33*a* clears ear 46, the owner pulls cross-latch member 33 to the left until end 33*b* is free of opening 48. With cross-latch member 33 free of dock-post bracket 32 the owner can remove dock post 9 from the dock-post bracket by laterally moving dock post 9 out of the U-shaped opening 44 in the dock-post bracket 32.

Thus with the present invention, a dock owner can laterally remove dock posts from the dock-post bracket 32 by removing the cross-latch member 33.

Figure 4:
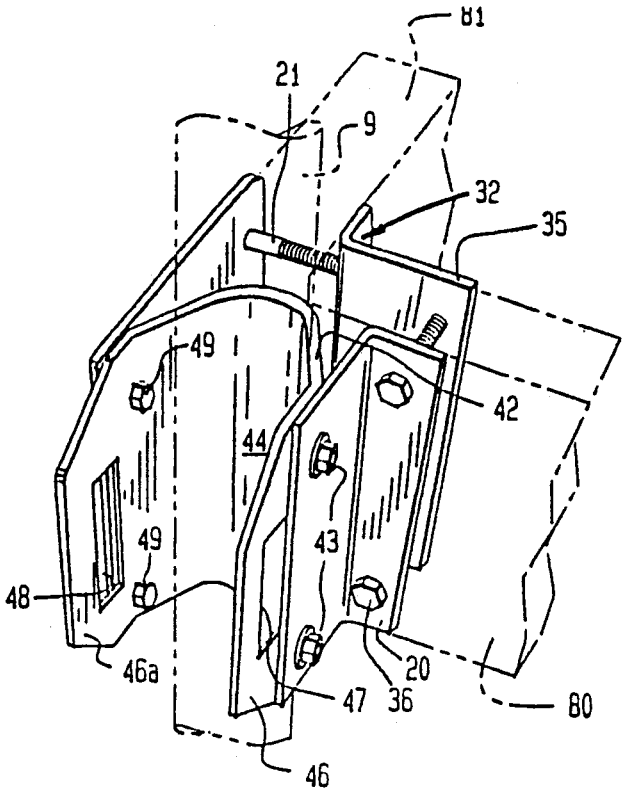
FIG. 4 shows the dock-post bracket of FIG. 2 turned upside down to form an end bracket for a dock.

A further feature of dock-post bracket 32 is that an owner can use the brackets on either side of a dock-deck section by merely turning the bracket 32 upside down. For example, FIG. 2 shows dock-post bracket 32 on the right corner of a dock-deck section and FIG. 4 illustrates an identical dock-post bracket 32 on the opposite corner of a dock-deck section. Thus, a feature of my bracket 32 is that it permits use of only one type of bracket for all four corners of a dock-deck section.

Similarly, dock-abutment bracket 31 can be turned upside down for use on the opposite corner of a dock-deck section.

Another feature of my dock-post bracket 32 is that an owner can turn it upside down so the same type of dock-post bracket can be used on all four corners of a dock-deck section; that is, if a dock owner wants to put dock posts on all four corners of the dock-deck section, he or she does not need different hardware for opposing ends of the dock. Instead the dock owner merely turns dock-post bracket upside down and fastens it to the opposite end of the dock.

Dock-post bracket 32 and cross-latch member 33 not only provide support for an adjacent dock-deck section but also permit the owner to use the identical dock kit for forming an support for a dock-deck section.

Figure 7:
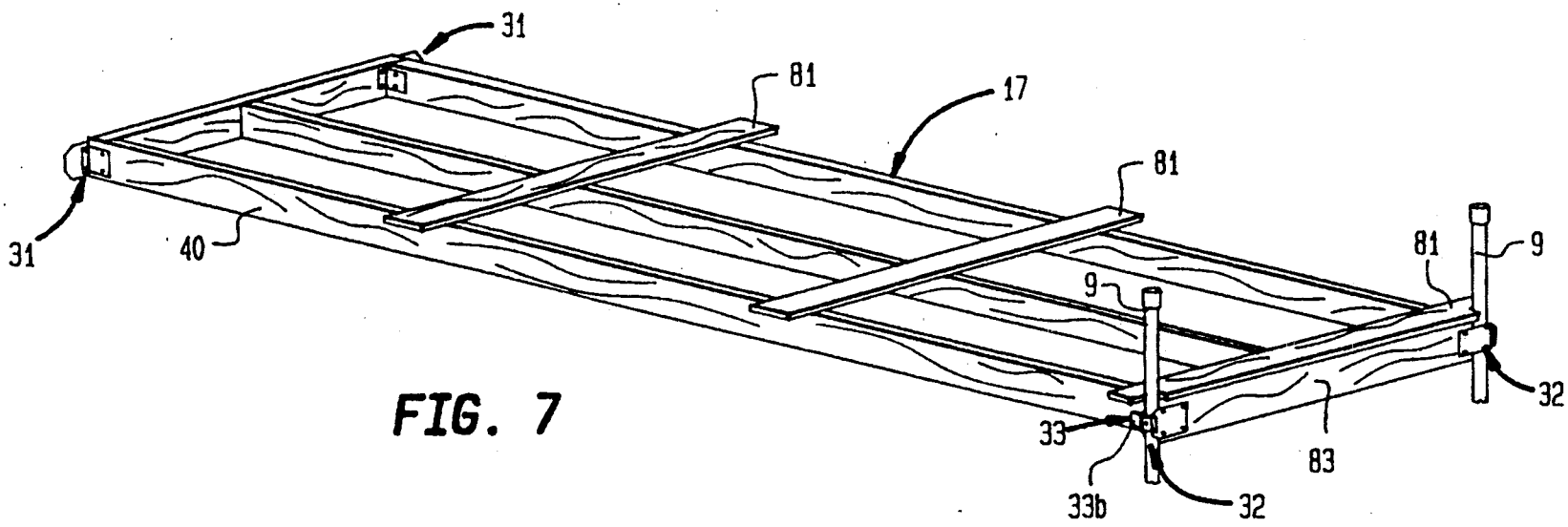
FIG. 7 shows a dock-deck section with two types of corner supports.

FIG. 7 shows a dock-deck section where the dock-post bracket 32 forms the end support of the dock. This arrangement reverses cross-latch member 33 so that the extension 33*b* points toward the dock-deck section, not outward to interfere with a person on the end of the dock. Thus reversible cross-latch member 33 permits a dock owner to use dock-post bracket 32 as either an end support for a dock or as an intermediate support for two adjacent dock-deck sections since the cross-latch member is asymmetric.

FIG. 1 shows a ramp dock-deck section 11 and a dock-deck section 12 with common dock posts 9 supporting them. To provide the connection for ramp dock-deck section 11, the owner mounts dock-post bracket 32 on dock-deck section 12 in the manner shown in FIG. 4. Next the owner reverses cross-latch member 33 so that extension end 33*b* extends outward so he or she can connect it to dock-abutment bracket 31 on ramp dock-deck section 11. The opening 45 in the dock-abutment bracket 31 is relatively large in relation to cross-latch member 33 so that cross-latch member 33 can sit at the angle of the ramp in the dock-abutment bracket 31. Thus my dock kit provides not only for reinforcing corners to permit sharing of dock posts but for supporting ramp dock-deck sections that are not parallel to each other.

FIG. 5 shows more detail of foot pad 70 of the present invention. The flange-like foot pad includes a first flange-like pad 60 and a second flange-like pad 62. In the center of pad 60 is an arcuate recess 61 which mates with the cylindrical surface of dock post 9. Similarly, located in the center of pad 62 is an arcuate recess 63 which mates with the cylindrical surface of dock post 9. Bolts 65 extend though the flange sections 66 and 67 to frictionally engage pads 60 and 62 around dock post 9. If an owner wants, he or she can assemble dock post 9 flush with the bottom of pad 60 and 62 or it can project through the pad so that the dock post sinks into the soil beneath the foot pad and prevents lateral movement of the dock posts thereby providing lateral stability to the entire dock.

In addition to my dock-abutment bracket, I also provide a corner reinforcement with a hanger to permit a dock owner to fasten an adjacent dock-deck section directly to the side of another dock-deck section. FIG. 1 shows hanger brackets 90 for engaging stringer 40.

FIG. 6 shows hanger bracket 90 in greater detail. Hanger bracket 90 is shown bolted directly on a dock-abutment bracket 31 to convert the dock-abutment bracket 31 into a corner reinforcement member with a side hanger. Note the flange 35 comprises two flat plates joined together at one edge to form a substantial 90 degree angle. Hanger bracket 90 has a straight section 92 with an underside 94 for engaging the top of a stringer. Hanger bracket 90 includes a curved member 91 to prevent hanger bracket 90 from sliding off a stringer. Hanger bracket 90 has a base 93 fastened to dock-abutment bracket 31 by bolts 39*a* that extend through flange 35. The advantage of hanger bracket 90 is that an owner can fasten it at different positions alongside an existing dock by merely inserting section 92 and curved member 91 in the regular spacings between adjacent dock-deck boards. Hanger bracket 90 allows not only quick, easy attachments, but allows the user to position the hangers into spaces between adjacent dock-deck boards on either side of a dock-deck section.

I claim:

1. A dock-post bracket to permit the owner to reinforce a corner of a dock-deck section and laterally install or remove a dock post in the dock-post bracket comprising:

a dock-post engaging member having a generally U-shape for extending around the exterior of a dock post;

a first ear located on said dock-post engaging member with said first ear having an opening therein;

a second ear located on said dock-post engaging member with said second ear having an opening therein, said opening in said first ear and said opening in said second ear located in alignment with each other;

a cross-latch member for engaging said dock-post engaging member, said cross-latch member having a first end for inserting through said opening in said first ear; said cross-latch member having a second end for inserting through said opening in said second ear, said first end extending outward from said dock-post bracket, said cross-latch member asymmetrical with said first end of said cross-latch member extending outward from said dock-post engaging member further than said second end of said cross-latch member, said first end of said cross-latch member having a surface extending sufficiently far from said dock-post engaging member to permit said first end of said cross-latch member to engage a dock-abutment bracket to support the adjacent corner of a dock-deck section; and means on said cross-latch member for lockingly engaging a dock post between said dock-post engaging member and said cross-latch member to permit a user to laterally insert a dock post in said dock-post engaging member and then install said cross-latch member in said dock-post engaging member to form an enclosure around a dock post so that one using said means can lockingly engage a dock post between said dock-post engaging member and said cross-latch member to permit said dock-post engaging member to support a corner of a dock-deck section.

2. The dock-post bracket of claim 1 including a first flange for fastening to said dock-post engaging member and to one side of a dock-deck section to sandwich the corner of a dock-deck section therein.

3. The dock-post bracket of claim 2 including a plate for fastening to said dock-post engaging member therein to provide a rigid corner reinforcement for the outside corner on a dock-deck section.

4. The dock-post bracket of claim 3 including a second flange for fastening to said dock-post engaging member and to one side of a dock-deck section and further means for sandwiching said first flange in the corner of a dock-deck section so that said second flange cooperates with said first flange and said plate to securely hold said dock-post bracket on a corner of a dock-deck section to thereby provide corner reinforcement for the dock-deck section.

5. The dock-post bracket of claim 1 wherein said dock-post engaging member has a top and a bottom with said U shape of said dock-post engaging member being substantially symmetrical so that dock-post bracket can be turned upside down for use on another corner of a dock-deck section.

6. A dock corner bracket to permit a user to reinforce the corner of a dock-deck section having a first member adjoining a second member at substantially a right angle to the first member comprising:

a first plate for attachment to the first member of a dock-deck section;

a second plate for attachment to the second member of a dock-deck section;

a flange for attachment to the first member and the second member of the dock-deck section;

said flange having a substantially right angle so that said first plate, said second plate and said flange comprise a corner reinforcement for the first member and the second member of a dock-deck section;

means for connecting said first plate, said second plate and said second flange so that said means for connecting, said first plate, said second plate and said second flange sandwiches the first member and the second member of the dock-deck section there between to provide reinforced corner for a dock-deck section; and further means for connecting said dock corner bracket to an adjacent docket corner bracket.

7. The dock corner bracket of claim 6 including means for attaching said dock corner bracket to another dock-deck section.

8. The dock corner bracket of claim 6 wherein said further means includes a cross-latch member, wherein said cross-latch member includes a stop to prevent lateral displacement of said cross-latch member when a dock post is held in said dock corner bracket by said cross-latch member.

9. The dock corner bracket of claim 8 wherein said first end of said cross-latch member includes an opening and a cotter key therein to permit said first end of said cross-latch member to be connected to a dock-abutment bracket.

10. A dock-post bracket to permit the owner to reinforce a corner of a dock-deck section and laterally install or remove a dock post in the dock-post bracket comprising:

a dock-post engaging member having a generally U-shape for extending around the exterior of a dock post;

a first ear located on said dock-post engaging member with said first ear having an opening therein;

a second ear located on said dock-post engaging member with said second ear having an opening therein, said opening in said first ear and said opening in said second ear located in alignment with each other;

a cross-latch member for engaging said dock-post engaging member, said cross-latch member having a first end for inserting through said opening in said first ear; said cross-latch member having a second end for inserting through said opening in said second ear, said cross-latch member first end having a surface extending sufficiently far from said dock-post bracket to permit said first end of said cross-latch member to engage a dock-abutment bracket to support the adjacent corner of a dock-deck section; and means on said cross-latch member for lockingly engaging a dock post between said dock-post engaging member and said cross-latch member to permit a user to laterally insert a dock post in said dock-post engaging member and then install said cross-latch member in said dock-post engaging member to form an enclosure around a dock post so that a person using said means can lockingly engage a dock post between said dock-post engaging member and said cross-latch member to permit said dock-post engaging member to support a corner of a dock-deck section.

11. The dock-post bracket of claim 1 wherein said means on said cross-latch member includes a stud bolt and a threaded recess to permit a user to rotate said stud bolt inward to sandwich a dock post between said cross-latch member and said dock-post engaging member.

* * * * *